US005082218A

United States Patent [19]

Hoffman

[11] Patent Number: 5,082,218

[45] Date of Patent: Jan. 21, 1992

[54] CONTAINER STAND

[76] Inventor: Ronald W. Hoffman, 10431 W. Catalina, Phoenix, Ariz. 85039

[21] Appl. No.: 560,164

[22] Filed: Jul. 13, 1990

Related U.S. Application Data

[60] Continuation-in-part of Ser. No. 465,962, Jan. 16, 1990, abandoned, which is a division of Ser. No. 309,217, Feb. 13, 1989, Pat. No. 4,898,352.

[51] Int. Cl.[5] ..... A63B 55/00

[52] U.S. Cl. ..... 248/96; 206/315.5; 206/315.7; 248/155; 248/588

[58] Field of Search ..... 248/150, 165, 166, 439, 248/188.6, 97, 96, 688, 291, 284, 278, 183, 184, 300; 206/315.7, 315.3, 315.5

[56] References Cited

U.S. PATENT DOCUMENTS

| | | | |
|---|---|---|---|
| 1,791,188 | 2/1931 | Bright | 206/315.7 X |
| 1,954,413 | 4/1934 | Hunter | 248/96 |
| 2,016,967 | 10/1935 | Komers | 248/96 |
| 2,436,688 | 2/1948 | Corbett | 206/315.5 X |
| 2,507249 | 5/1950 | Dorazio | 206/315.5 X |
| 2,768,668 | 10/1956 | Santosuosso | 206/315.7 |
| 3,195,844 | 7/1965 | Roepke | 206/315.7 X |
| 3,787,017 | 1/1974 | Sauer | 248/96 |
| 4,087,068 | 5/1978 | Gardner | 248/355 |
| 4,226,389 | 10/1980 | Neth | 248/96 |
| 4,383,563 | 5/1983 | Kirchhoff | 206/315.5 X |
| 4,522,299 | 6/1985 | Clark et al. | 248/96 X |
| 4,739,958 | 4/1988 | Sato | 248/96 |
| 4,778,136 | 10/1988 | Reimers | 248/96 |
| 4,798,357 | 1/1989 | Cho | 248/96 |
| 4,834,235 | 5/1989 | Solheim et al. | 248/96 X |
| 4,858,761 | 8/1989 | Fumia | 206/315.5 X |
| 4,898,352 | 2/1990 | Hoffmann | 248/96 |

*Primary Examiner*—Ramon O. Ramirez
*Attorney, Agent, or Firm*—Don J. Flickinger; Jordon M. Meschkow

[57] ABSTRACT

A supporting device which attaches to a wide variety of containers and exhibits a first, unobtrusive position for storing or transporting a container and a second, supporting position for holding the container in an upright orientation is disclosed. A bracket attaches either directly to the container or to a strap which in turn attaches to the container. The bracket rotationally couples to first and second legs. When the legs are in their first positions, they reside substantially parallel to each other and immediately next to the container. However, when the legs are in their second positions, they extend outward from the container and at an angle with each other. Consequently, the legs and the container form a tripod which maintains the container in the upright orientation. Various blocking structures are provided in connection with the bracket and legs to prevent rotation of the legs beyond their first and second positions.

14 Claims, 4 Drawing Sheets

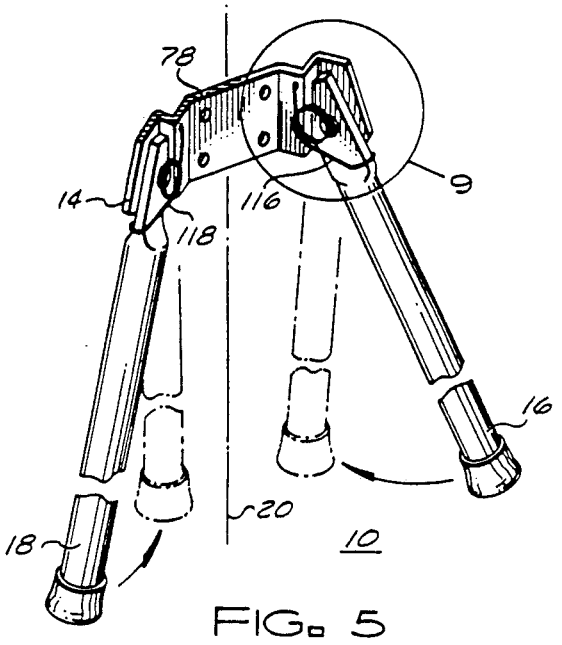
FIG. 5
FIG. 6
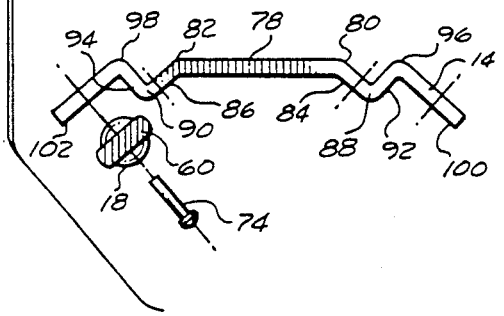
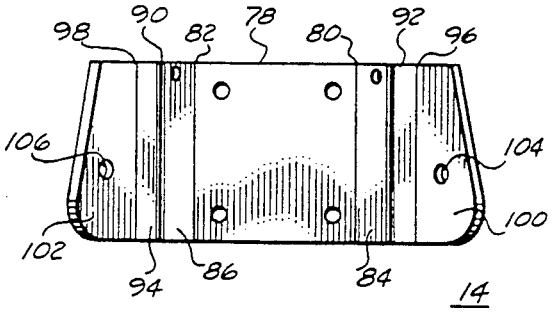
FIG. 7
FIG. 8
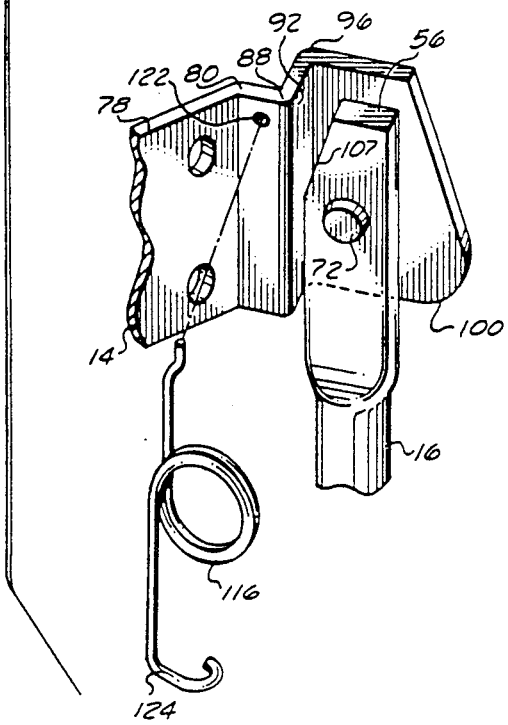
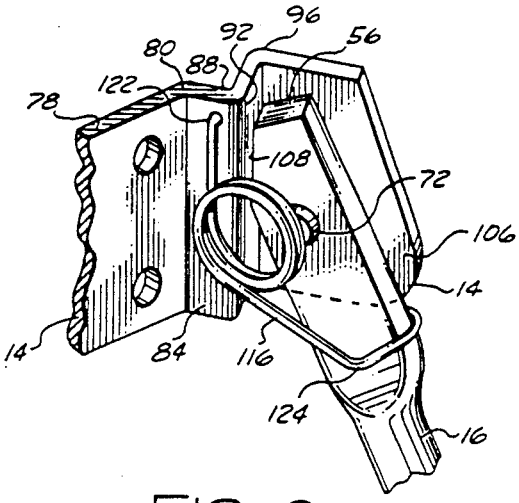
FIG. 9

FIG. 16
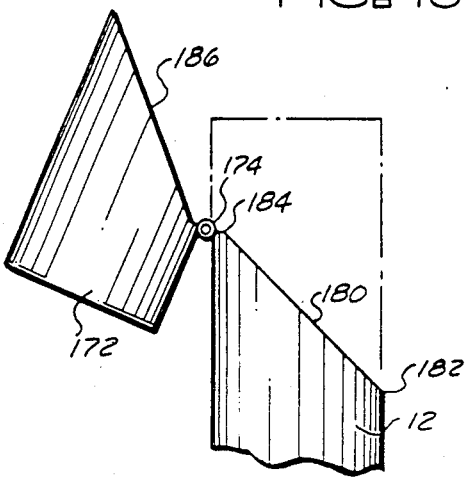
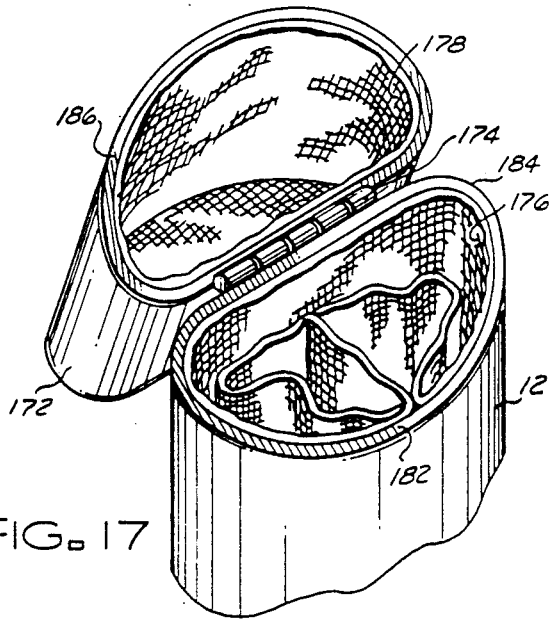
FIG. 17
FIG. 18
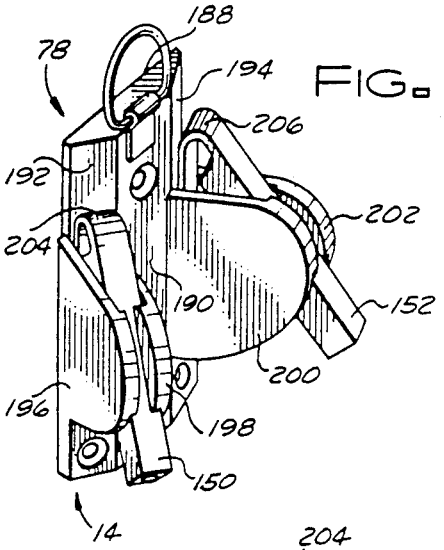
FIG. 19
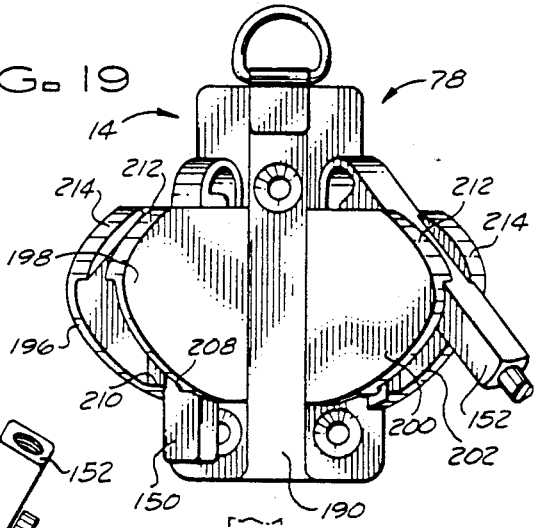
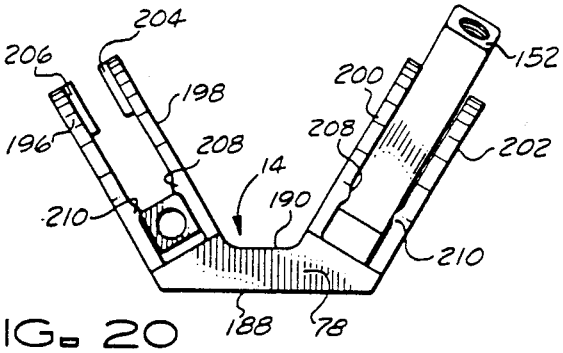
FIG. 20
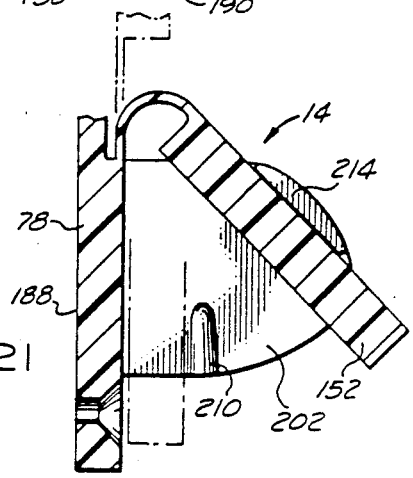
FIG. 21

CONTAINER STAND

This is a continuation-in-part of application Ser. No. 465,962, Filed 16 January 1990, which was a Divisional of application Ser. No. 309,217, filed 13 February 1989, which issued as U.S. Pat. No. 4,898,352 on 6 February 1990.

FIELD OF THE INVENTION

The present invention relates generally to supporting structures for devices, such as containers, boxes, carrying cases, bags, and the like. More specifically, the present invention relates to a supporting structure which maintains a device in an upright orientation so that the weight of the device is distributed between the device and the supporting structure.

BACKGROUND OF THE INVENTION

Many containers which are designed for storing and transporting valuable objects operate well for those purposes but fail to address the specific needs associated with the removal of the objects from the container. For example, if the container holds a plurality of objects and a user wishes to remove only a specific one of the objects, then the user must select the desired object from all of the objects in the container.

In order for a user to see the container contents so that the desired one of the objects contained therein may be selected, the container must often be placed in an upright orientation, wherein a container opening faces generally upward so that it faces the user's eyes. However, conventional prior art containers, such as tube shapes, bags, rectangular shapes, and the like, occasionally place the container opening on a side which does not normally face upward when the container is placed on a surface. Consequently, the user faces undesirable choices in selecting a desired one of the objects in the container.

To select a desired object, the user may elect to hold the container in an upright orientation so that the user can see into the container to select and remove only the desired object. This procedure is inconvenient and undesirable because it ties up the user's hands so that the user cannot continue to hold other objects while retrieving a desired object from the container. Moreover, in many situations, large or flexible containers are configured so that two hands are required to hold such containers in an upright position without spilling multiple objects contained therein. In such situations the election to hold a container in an upright orientation is extremely inconvenient and undesirable because two people may be required to remove the desired object.

Alternatively, to select a desired object the user may elect to remove all objects from a conventional container, spread such objects on a surface where they may be readily observed, and select the desired object. The removal of all objects in the container is also inconvenient and undesirable because it necessitates the use of a suitable surface, which is often unavailable, and the additional step of replacing all the unselected objects back into the container. This additional step is time consuming and imposes an added potential risk of loss or harm on the unselected objects.

The above-mentioned possibilities are even more undesirable when the objects held by the container are unusually sensitive or expensive and therefore preferably handled as little as possible. Moreover, these problems are again exacerbated when the objects held by the container are repeatedly removed and returned to the container in the course of normal use.

SUMMARY OF THE INVENTION

Accordingly, it is a advantage of the present invention that a support which holds a container in an upright orientation is provided.

Another advantage is that the present invention is configured to operate in two modes wherein it may selectively support a container or be unobtrusively positioned adjacent to the container.

Yet another advantage is that the present invention is configured to operate in connection with a wide variety of conventional containers without requiring modification of such conventional containers.

The above and other advantages of the present invention are carried out in one form by a supporting apparatus which includes a bracket, a first leg, and a second leg. The bracket has an attachment plate which is securable to a suitable object, such as a container. Moreover, the bracket is configured to define a weight-supporting line, which represents the portion of the container that serves as a third leg of a tripod formed by the present invention and the object. The first and second legs moveably couple to the bracket so that they may selectively reside in first and second positions. When the first and second legs are in their first positions, they are generally parallel to each other and to the weight-supporting line defined by the bracket. When the first and second legs are in their second positions, they each form an acute angle with the weight-supporting line and an angle with each other.

BRIEF DESCRIPTION OF THE DRAWINGS

A more complete understanding of the present invention may be derived by referring to the detailed description and claims when considered in connection with the FIGURES, wherein like reference numbers refer to similar items throughout the FIGURES, and:

FIG. 5 shows an enlarged perspective view of a second embodiment the present invention;

FIG. 6 shows a top view of the second embodiment of the present invention;

FIG. 7 shows a side view of a bracket portion of the second embodiment of the present invention;

FIG. 8 shows a detailed view of a leg in its first position coupled to the bracket portion of the second embodiment of the present invention; and FIG. 9 shows a detailed view of a leg in its second position coupled to a bracket portion of the second embodiment of the present invention.

FIG. 16 shows a fragmentary side view of the top portion of a container stand according to an alternate embodiment of the invention;

FIG. 17 shows a perspective view of the container stand shown in FIG. 16;

FIG. 18 shows a perspective view of a bracket according to a fourth embodiment of the invention;

FIG. 19 shows a front view of the bracket shown in FIG. 18;

FIG. 20 shows a bottom view of the bracket shown in FIGS. 18 and 19; and

FIG. 21 shows a sectional view taken through the extended leg of the bracket shown in FIG. 1.

DETAILED DESCRIPTION OF THE PREFERRED EMBODIMENTS

Figure 1:
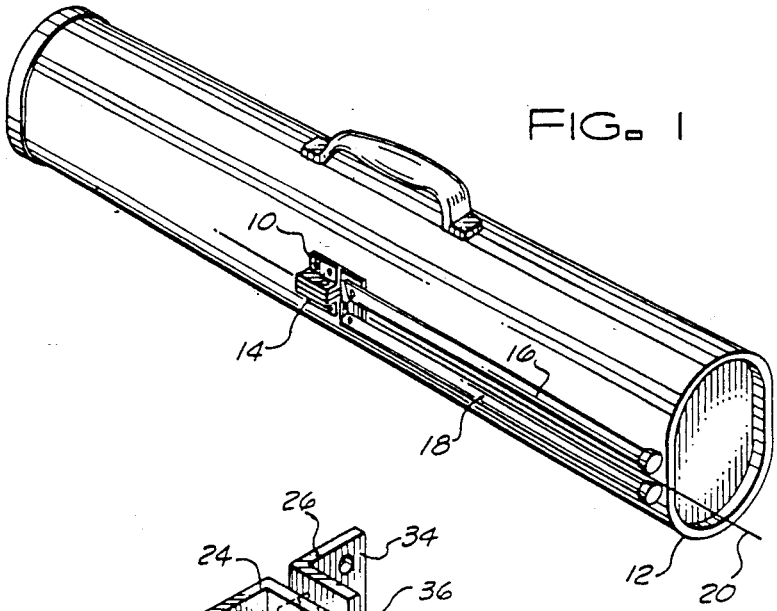
FIG. 1 shows a perspective view of the present invention attached to a container with legs of the present invention in a first position.
Figure 2:
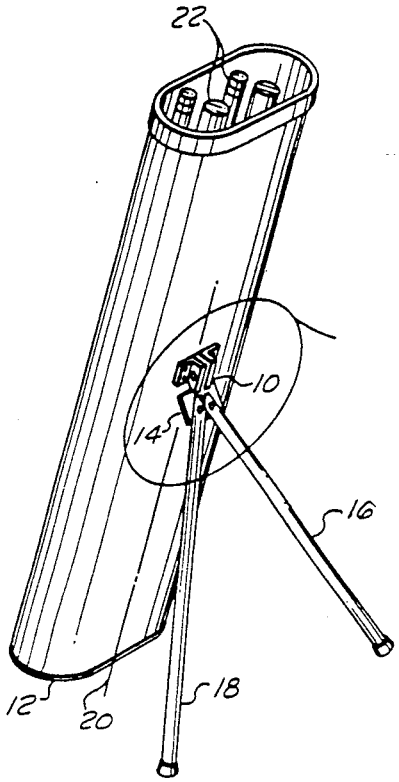
FIG. 2 shows a perspective view of the present invention attached to a container with legs of the present invention in a second position.

FIGS. 1 and 2 each show the present invention as a support 10 which attaches to a container 12. Support 10 includes a bracket 14, a first leg 16, and a second leg 18. Bracket 14 immovably attaches to container 12, and legs 16–18 are movable relative to bracket 14. The attachment of bracket 14 occurs in a central area of the exterior of container 12. FIG. 1 illustrates the present invention with legs 16–18 each in a first position, and FIG. 2 illustrates the present invention with legs 16-18 each in a second position.

When legs 16–18 are in their first positions (see FIG. 1), legs 16–18 are substantially parallel to each other. In addition, in the first positions, legs 16–18 reside adjacent to container 12 and do not extend beyond the perimeter of container 12. With legs 16–18 in their first positions, container 12 is prepared for storage or transportation, and legs 16–18 are unobtrusively positioned so as not to interfere with such storage or transportation.

When in their first positions, legs 16–18 additionally reside substantially parallel to and near an imaginary weight-supporting line 20. Weight-supporting line 20 is defined by the orientation of bracket 14, and is shown in FIGS. 1–2 as being an imaginary line on the surface of container 12. Consequently, when support 10 is attached to container 12, the projection of weight-supporting line 20 on container 12 represents the portion of container 12 which serves as a third leg of a tripod formed with first and second legs 16–18, when in their second positions (see FIG. 2).

As shown in FIG. 2, support 10 operates to position container 12 in an upright orientation in which the weight of container 12 and contents 22 thereof is distributed between legs 16–18 and container 12, including contents 22. This upright orientation permits contents 22 to be readily observed so that desired ones of contents 22 may be selected and removed from container 12 without container 12 being hand-held and without requiring excessive handling or removal of non-desired ones of contents 22.

FIG. 2 illustrates container 12 as being a relatively rigid, tube-shaped object and contents 22 as being sections of a billiards cue. However, the present invention is in no way limited to such configurations of container 12 and contents 22. For example, container 12 may alternatively represent a flexible container, such as a sack or bag, where the weight supporting function is performed more by contents 22 than by container 12. In addition, container 12 may exhibit any of a wide variety of shapes and sizes. Furthermore, container 12 may alternatively hold golf clubs, baseball bats, other sporting items, medical instruments, scientific instruments, tools, or the like.

Figure 3:
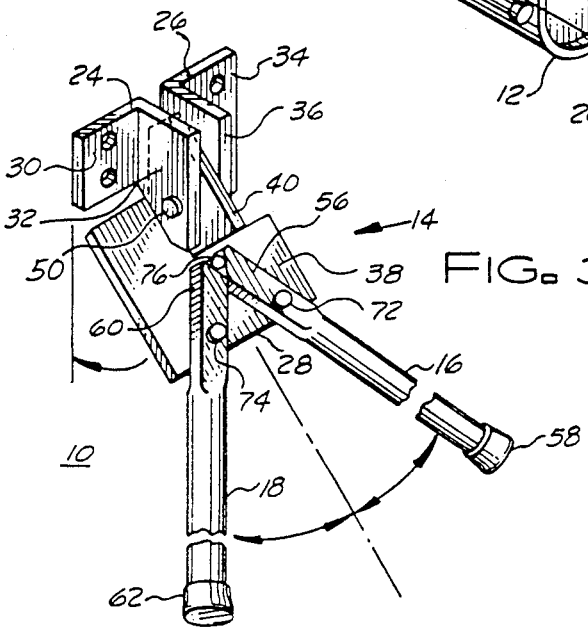
FIG. 3 shows an enlarged perspective view of a first embodiment of the present invention.
Figure 4:
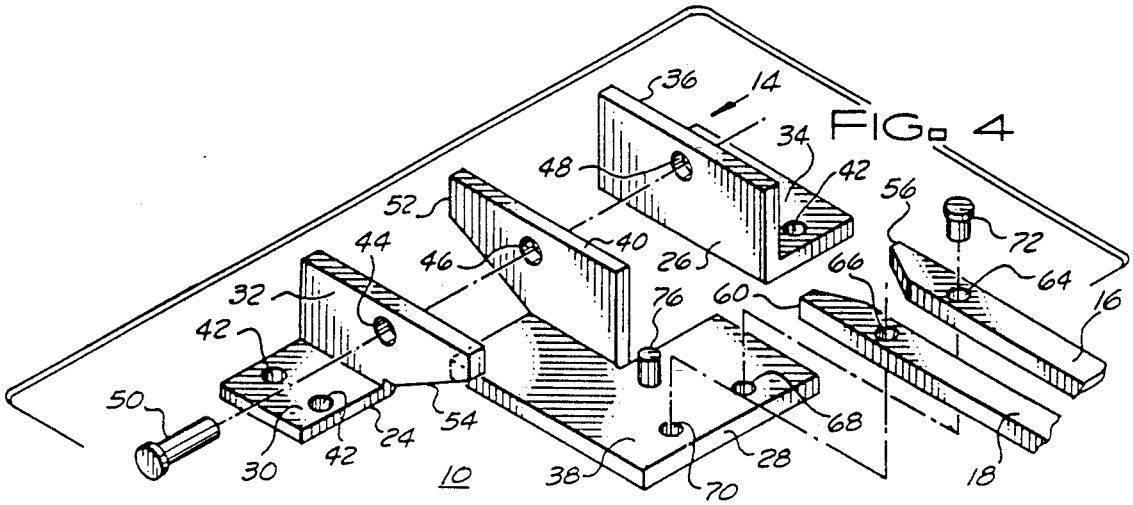
FIG. 4 shows an exploded view of the first embodiment of the present invention.

FIGS. 3 and 4 each show details of a first embodiment of support 10. FIG. 3 shows the components of support 10 operationally assembled with legs 16–18 in their second positions. FIG. 4 shows an exploded view of the components of support 10. With reference to FIGS. 3–4, bracket 14 includes left and right attachment members 24 and 26, respectively, and a rotating member 28. Left attachment member 24 includes an attachment plate 30 perpendicularly and rigidly attached at one end to a planar attachment support 32. Likewise, attachment member 26 includes an attachment plate 34 perpendicularly and rigidly attached at one end to a planar attachment support 36. Similarly, rotating member 28 includes a rotating plate 38 perpendicularly and rigidly attached to a planar rotating support 40. Each of members 24–28 may advantageously be formed into single integral units Attachment plates 30 and 34 couple to container 12 at surface thereof which oppose the direction in which supports 32 and 36, respectively, extend away from plates 30 and 34. FIGS. 3–4 illustrate such attachment through the use of holes 42 in connection with rivets or screws (not shown). However, the present invention contemplates the use of any conventional attaching technique, including a suitable adhesive.

When assembled, supports 32 and 36 reside parallel to and on opposing sides of support 40. Supports 32, 40, and 36 have aligned holes 44, 46, and 48, respectively, therethrough, and a pivot pin 50 extends through holes 44–48 to rotatably couple rotating member 28 to attachment members 24 and 26.

Rotating member 28 may selectively reside in or between two extreme positions. In a first position, which is illustrated in FIGS. 1 and 4, rotating plate 38 resides substantially coplanar with attachment plates 30 and 34. When attached to container 12, rotating plate 38 is prevented from rotating beyond this first position by container 12 (see FIG. 1).

In a second position, which is illustrated in FIGS. 2 and 3, rotating plate 38 has pivoted a small distance away from attachment plates 30 and 34 so that an obtuse angle forms therebetween. Rotating support 40 has an edge 52 (see FIG. 4) which faces container 12 and resides above pivot pin 50 when viewing FIG. 3. Edge 52 tapers outward from rotating plate 38 so that support 40 does not interfere with the rotation of rotating member 28 or damage container 12.

In addition, attachment support 32 overlies rotating plate 38 and has an edge 54 which tapers away from attachment plate 30 at an angle that defines this obtuse angle. Specifically, edge 54 abuts rotating plate 38 when rotating member 28 is in its second position and thereby prohibits rotation of rotating member 28 beyond the second position.

As shown in FIGS. 3–4, leg 16 has first and second ends 56 and 58, respectively, and leg 18 has first and second ends 60 and 62, respectively. Legs 16 and 18 are each generally tubular structures with flattened portions proximate first ends 56 and 60. Legs 16 and 18 additionally have holes 64 and 66, respectively, therethrough centrally located in these flattened portions. Rotating plate 38 has holes 68 and 70, and pivot pins 72 and 74 extend through holes 64 and 68, respectively, and holes 66 and 70, respectively, to rotatably couple first and second legs 16 and 18 to rotating plate 38.

As discussed above, legs 16 and 18 reside in first and second positions. Legs 16 and 18 are prohibited from extending beyond their first positions by mutual contact with each other. A blocking pin 76 is positioned on rotating plate 38 and extends outward therefrom to contact first ends 56 and 60 of legs 16 and 18, respectively, when legs 16 and 18 reach their second positions. Consequently, blocking pin 76 prohibits rotation of legs 16 and 18 beyond their second positions. Alternatively, as illustrated in FIG. 4, first ends 56 and 60 may be complementarily tapered so that they squarely abut each other as legs 16 and 18 reach their second positions. Thus, ends 56 and 60 may operate to block rotation of legs 16 and 18 beyond their second positions.

Thus, the carrying and storing position for legs 16 and 18, shown in FIG. 1, occurs when rotating member 28 is placed in its first position and when legs 16 and 18 are in their first positions. The supporting position for legs 16 and 18, shown in FIG. 2, occurs when rotating member 28 is placed in its second position and when legs 16 and 18 are in their second positions.

FIGS. 5–9 illustrate a second embodiment of support 10. As discussed above in connection with the first embodiment, support 10 includes bracket 14, first leg 16 and second leg 18. In addition, bracket 14 defines a weight-supporting line 20 as a result of the orientation of an attachment plate 78 thereof. However, the second embodiment of the present invention differs from the above-discussed first embodiment in the manner in which legs 16 and 18 couple to bracket 14.

FIGS. 6–7 illustrate details of bracket 14. In this second embodiment, bracket 14 is formed from a substantially planar plate to exhibit a non-planar shape. Specifically, attachment plate 78 of bracket 14 is substantially planar and has opposing ends 80 and 82. At ends 80 and 82, bracket 14 is bent at substantially identical obtuse angles with plate 78 in a first direction to form first and second angled plates 84 and 86, respectively. Plates 84 and 86 are each generally planar structures which extend from ends 80 and 82, respectively, to ends 88 and 90, respectively. At ends 88 and 90, bracket 14 bends in a second direction, which is opposite to the first direction, for approximately 90° to form blocking plates 92 and 94, respectively. Plates 92 and 94 are each generally planar structures which extend from ends 88 and 90, respectively, to ends 96 and 98, respectively. At ends 96 and 98, bracket 14 bends in the first direction for approximately 90° to form rotation plates 100 and 102, respectively.

Rotation plates 100 and 102 do not move relative to the other sections of bracket 14 but rotatably couple to legs 16 and 18, respectively (see FIG. 5). Specifically, rotation plates 100 and 102 have holes 104 and 106, respectively, therein. Legs 16 and 18 are configured substantially as described above in connection with the first embodiment. Consequently, pivot pins 72 and 74 extend through openings 64 and 66 in legs 16 and 18, respectively (see FIG. 4). In addition, pivot pins 72 and 74 extend through holes 104 and 106, respectively (see FIGS. 6–8) in this second embodiment.

Legs 16 and 18 each rotate between the first position an the second position. Phantom lines in FIG. 5 show legs 16 and 18 in their first positions while solid lines in FIG. 5 show legs 16 and 18 in their second positions. In addition, FIG. 8 shows leg 16 in the first position and FIG. 9 shows leg 16 in the second position Referring to FIG. 8, leg 16 is prohibited from extending beyond its first position by contact between an edge portion 107 of leg 16 and blocking plate 92. Edge portion 107 resides on the opposite side of pivot pin 72 from first end 56, and faces blocking plate 92.

FIG. 9 shows leg 16 in its second position. An edge portion 108 of leg 16 also faces blocking plate 92 but resides on the same side of pivot pin 72 as first end 56. Consequently, rotation of leg 16 away from the first position causes edge portion 108 to contact blocking plate 92 when the second position of leg 16 is reached. Moreover, edge portion 108 tapers inward to define the angle at which leg 16 resides when in its second position. Thus, the mutual configuration of blocking plate 92 and edge portion 108 prevent rotation of leg 16 beyond its second position. Of course, although not specifically shown, those skilled in the art will recognize that leg 18 operates in the same manner as leg 16.

With continued reference to FIGS. 5 and 8–9, the second embodiment of the present invention additionally includes springs 116 and 118 in connection with legs 16 and 18, respectively FIGS. 8–9 illustrate the coupling between spring 116, leg 16, and bracket 14. Those skilled in the art will understand that spring 118 similarly operates with leg 18. Specifically, a first end 120 of spring 116 attaches to first angled plate 84 of bracket 14 at an opening 122 therethrough. A second end 124 exhibits a hook shape which couples directly to the perimeter of leg 16. Spring 116 is biased to urge leg 16 into its first position. Consequently, leg 16 tends to remain secured in its first position when not in its second position. The strength of spring 116 is relatively weak so that leg 16 remains in its second position when a proportionate share of the weight of container 12 is applied to leg 16. In addition, detents (not shown) may advantageously be provided between leg 16 and rotating plate 100 to lock leg 16 in its second position and prevent leg 16 from returning to its first position, even when no weight is on leg 16.

FIGS. 10–14 illustrate a container 12 and container support 10 according to a third embodiment of the invention. In general similarity to the previous embodiments, container 12 comprises a substantially tubular body having an open interior into which elongated objects, such as billiards cues, may be inserted. However, a flexible liner 126 has been added for protecting the inner surface of the container 12 and the contents of the container from scratching and other damage. Liner 126 comprises a single sheet of flexible material which has been folded and stitched in such a way as to form four individual pockets or compartments for separating the contents of the container from one another. For instance, if the container 12 is used for holding sectional billiards cues, two of the pockets may be used for holding cue shafts, and the other two pockets may be used to hold cue butts.

Support 10 comprises bracket 14, first leg 16, and second leg 18. In this embodiment, bracket 14 comprises a substantially planar attachment plate 78 which is immovably secured to container 12. A second plate 128 having its opposite ends bent at obtuse angles to form a first pair of outwardly projecting ears 130, 132 is mounted on second plate 128.

Figure 10:
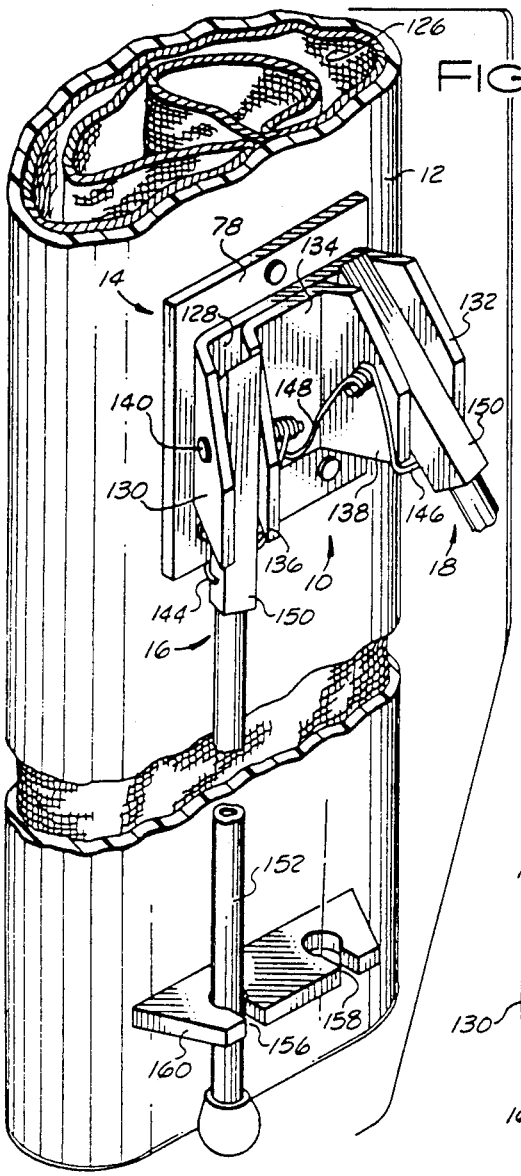
FIG. 10 shows a fragmentary perspective view of a third embodiment of invention.
Figure 11:
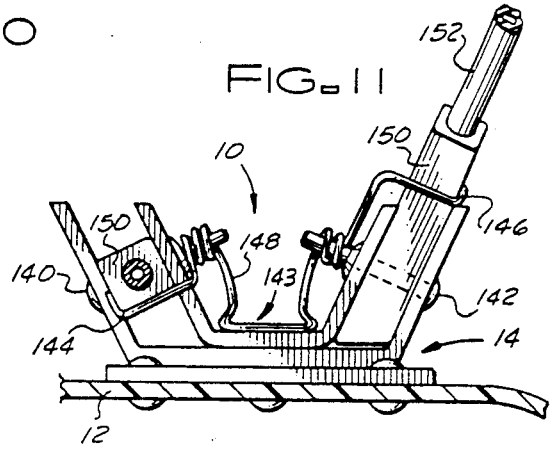
FIG. 11 shows a sectional view taken through line 11—11 of FIG. 10.
Figure 12:
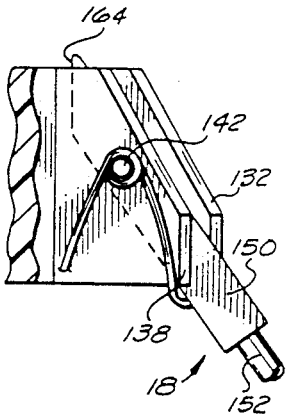
FIG. 12 shows a fragmentary view of a leg in its second position coupled to the bracket portion of the third embodiment of the present invention.
Figure 13:
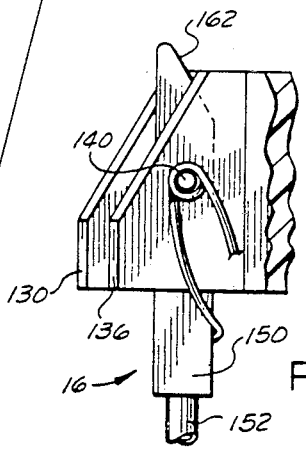
FIG. 13 shows a fragmentary view of a leg in its first position coupled to the bracket portion of the third embodiment of the present invention.

First leg 16 is mounted between ear 130 of second plate 128 and ear 136 of third plate 134. Second leg 18 is mounted between ear 132 of second plate 128 and ear 138 of third plate 134. Legs 16 and 18 are pivotally secured to ears 130, 132 and 136, 138, respectively, by pivot pins 140, 142 which extend through aligned holes in the legs 18, 18 and ears 130, 132, 136, and 138. The pivotal coupling between legs 16, 18 and ears 130, 132, 136, and 138, enables legs 16 and 18 to rotate between first and second positions, as in the previous embodiments. In FIG. 10, leg 16 is shown in the first position, while leg 18 is shown in the second position.

A single resilient wire 143 having a first hooked end 144 which couples to leg 16, a second hooked end 146 which couples to leg 18, and an intermediate portion 148 which coils around pivot pins 140, 142, acts as a spring for urging legs 16, 18 toward the second position. Because the hooked ends 144, 146 of wire 143 attach to the back portion of the legs 16, 18, rather than the front portion, as in the embodiment of FIGS. 5 and 8–9, the bias of the spring is opposite to that of the earlier embodiment. Accordingly, the legs 16, 18 tend to remain in the second position, normally maintaining the container 10 in stable, upright position, even when the container is relatively lightweight.

Figure 14:
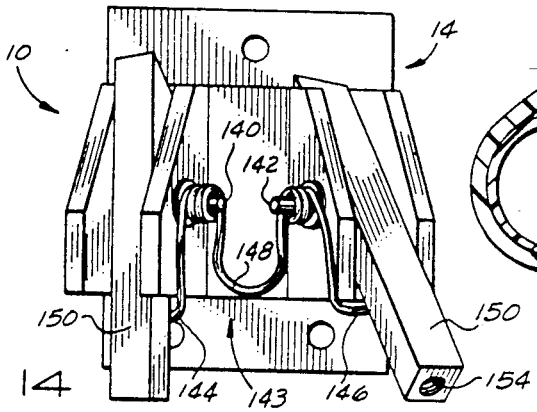
FIG. 14 shows a front view of the bracket of the third embodiment of the present invention.

Legs 16, 18 differ from their counterparts in the previous embodiments in that they are sectional. That is, each leg 16, 18 comprises an upper mounting portion 150 which is permanently pivotally secured to bracket 14 and a lower extension portion 152 detachably coupled to the mounting portion 150. As shown in FIG. 14, mounting portion 150 of each leg 16, 18 comprises an internally threaded bore 154 which receives the externally threaded top end (not shown) of the corresponding leg 16 or 18. Thus, the illustrated coupling between mounting portion 150 and extension portion 152 is a screw coupling. However, other types of couplings will readily occur to the skilled practitioner. Furthermore, the locations of the male and female coupling elements may be reversed. In other words, mounting element 150 may comprise an externally threaded projection, while extension element may include an internally threaded bore.

Retaining means are provided for holding legs 16, 18 in their first position, against the bias of spring 143, when the container 12 is not being supported in an upright position In FIG. 10, the retaining means are in the form of a pair of keyhole slots 156, 158 formed in a shelf 160 projecting perpendicularly from the outer surface of container 12 proximate the bottom end thereof. Shelf 160 is formed of material of sufficient resilience to allow the open ends of slots 1256, 158 to flex apart and release legs 16, 18 in response to a light, outward manual pull on legs 16, 18.

The upper edges 162, 164 of mounting portion 150 of legs 16 and 18, respectively, taper inwardly to define the angle at which legs 16 and 18 reside when in their second position. Thus, when legs 16 and 18 are rotated outwardly, the tapered edges 162 and 164 contact the portion of second plate 128 between ears 130, 136 and 132, 138, respectively, to cooperatively define a stop means, similar to that shown in the embodiment of FIGS. 5–9, for preventing the legs from moving beyond their second position.

Figure 15:
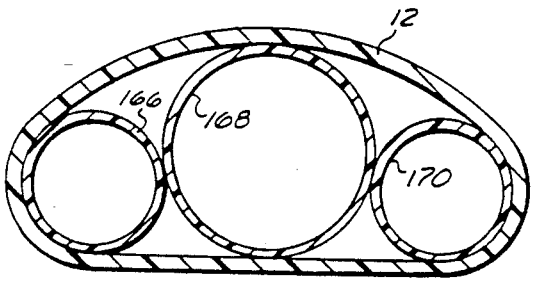
FIG. 15 shows a section through a container similar to the container stand shown in FIG. 10, but having an alternate divider configuration.

FIG. 15 is a sectional view of an alternate embodiment of the invention, wherein the flexible lining of FIG. 10 has been replaced by a plurality of rigid tubes 166, 168, 170 for dividing the interior into separate compartments. The tubes enable a user to organize and separate a number of different components, such as the butts and shafts of a billiard cue set, or the various arrows of an archery quiver. Each of the tubes 166, 168, 170 may be provided with an optional liner (not shown) for protecting the tubes and their contents from damage.

Another embodiment of container 12, wherein the container 12 includes a hinged lid 172, is illustrated in FIGS. 16 and 17. Any conventional hinge 174 may be used for coupling lid 172 to container 12. Furthermore, both container 12 and lid 172 may include liners 176, 178. An important feature of container 12 is the orientation of container mouth 180 which extends along a plane forming an acute angle with respect to the longitudinal axis of the tube. Thus the front top edge 182 of the container is lower that the rear front edge 184. This allows for greater visibility and easier selection and withdrawal of the articles in the container. The lower edge 186 of lid 172 is angled in the same way as upper edge 182 of container 12 to ensure that lid 172 seats properly.

FIGS. 18–21 show yet another embodiment of bracket 14, which is a unitary body molded from thermoplastic material. The bracket 14 according to this embodiment comprises an attachment plate 78 having a substantially straight back surface 188 for placement against the outer surface of container 12. The front surface of attachment plate 78 includes a central portion 190 which is generally parallel to back surface 188, and a pair of opposite side portions 192, 194 each of which extends at an obtuse angle with respect to central portion 190. A first pair of spaced apart ears 196, 198 is integrally secured to and project normally from first side surface 192, and a second pair of spaced apart ears 200, 202 are integrally secured to and project normally from second side surface 194.

Upper mounting portions 150, 152 of legs 16 and 18 are carried between ears 196, 198 of the first ear pair, and ears 200, 202 of the second ear pair, respectively. Upper mounting portions 150 and 152 are integrally secured to side surfaces 192 and 194, respectively, by means of thin, flexible hinges 204, 206 which also serve as springs for urging mounting portions 150, 152 of legs 16, 18 toward their second positions.

When container 12 is not in use, each leg 16, 18 is held in its first position by a pair of opposed retaining beads 208, 210 formed on the inner surface of each of the ears 196, 198, 200, 202. The distance between each bead and the corresponding surface of bracket 14 is approximately equal to the thickness of legs 16, 18 so that the legs 16, 18 are substantially flat against the outer surface of container 12 when in the first position. Ears 196, 198, 200, 202 are sufficiently resilient to allow beads 208, 210 to flex apart in response to a light, manual pull on legs 16 and 18.

Legs 16 and 18 are prevented from moving beyond their second position by means of a pair of opposed stop walls 212, 214 which project inwardly from the inner surface of each of the ears 196, 198, 200, 202, at a location above and forward of beads 208, 210. The surface of each stop wall 204, 206 which falls a leg 16, 18 is tapered inward to define the angle at which leg 16, 18 resides when in its second position.

In summary, the present invention provides a support which selectively holds a container in an upright orientation so that contents of the container may be readily observed. With legs of the present invention in first positions, the present invention is unobtrusively positioned adjacent to the container. With the legs in second positions, the present invention may support the container in the upright orientation. Moreover, the present invention is easily attached and used in connection with a wide variety of container sizes, shapes, and materials without requiring modification of the containers. The present invention has been described above with reference to a preferred embodiment. However, those skilled in the art will recognize that changes and modifications may be made in these preferred embodiments without departing from the scope of the present invention. These and other changes and modifications which are obvious to those skilled in the art are intended to be included within the scope of the present invention.

What is claimed is:

1. A supporting apparatus for attachment to an object to selectively position said object in an upright orientation, said supporting apparatus comprising:

(a) a bracket having an attachment plate securable to said object, said attachment plate defining a weight-supporting line, and including (i) a first pair of parallel spaced apart ears, each of said ears in said first pair secured proximate a first side of said attachment plate, and (ii) a second pair of parallel spaced apart ears, each of said ears in said second pair being secured proximate a second side of said attachment plate at an angle thereto;

(b) a first leg pivotally mounted between said ears in said first pair so that said first leg selectively resides in one of a first position generally parallel to said weight-supporting line and a second position at an acute angle to said weight-supporting line;

(c) a second leg pivotally mounted between said ears in said second pair so that said second leg selectively resides in one of a first position generally parallel to said weight-supporting line and a second position at an acute angle to said weight-supporting line, said second leg being at an angle with said first leg when said first and second legs are in said second positions;

(d) biasing means for urging said first and second legs toward said second positions;

(e) retaining means for holding said first and second legs in said first position against the urging of said biasing means; and (f) stop means for limiting rotation of said first and second legs relative to said attachment means so that movement beyond said second positions of said first and second legs is prohibited.

2. The supporting apparatus according to claim 1, wherein each of said first and second legs comprises:

(a) a mounting portion pivotally secured to said bracket; and (b) an extension portion detachably coupled to said mounting portion, for extending from said mounting portion to the surface on which said object is to be supported.

3. The supporting apparatus according to claim 1, wherein said stop means comprises a tapered edge portion formed at the upper end of each of said legs, said tapered edge portion defining an angle equal to the angle which each of said legs defines relative to said weight supporting line and contacting a portion of said attachment plate between said ears in one of said ears to prevent rotation of said legs beyond said second position.

4. The supporting apparatus according to claim 1, wherein said retaining means comprises (a) a first pair of opposed, resilient beads formed on the inner surface of each of said ears in said first pair (b) a second pair of opposed resilient beads formed on the inner surface of each of said ears in said second pair;

the distance between each of said bead pairs and said bracket being approximately equal to the thickness of said legs.

5. The supporting apparatus according to claim 1, wherein said stop means comprises a pair of opposed stop walls projecting inwardly from the inner surface of each of said ears of each of said ear pairs to prevent said legs from moving beyond said second position.

6. A supporting apparatus for attachment to an object to selectively position said object in an upright orientation, said supporting apparatus comprising:

(a) a bracket having an attachment plate securable to said object, said attachment plate defining a weight-supporting line;

(b) a first leg moveably coupled to said bracket so that said first leg selectively resides in one of a first position generally parallel to said weight-supporting line and a second position at an acute angle to said weight-supporting line;

(c) a second leg moveably coupled to said bracket so that said second leg selectively resides in one of a first position generally parallel to said weight-supporting line and a second position at an acute angle to said weight-supporting line, said second leg being at an angle with said first leg when said first and second legs are in said second positions;

(d) biasing means for urging said first and second legs towards said second positions;

(e) retaining means for holding said first and second legs in said first position against the urging of said biasing means, said retaining means including (i) resilient shelf means securable to said object for projecting from said object at a location spaced below said bracket, and (ii) a pair of key hole slots formed in said shelf means, each slot for receiving one of said legs to hold said leg in said first position; and (f) stop means for limiting rotation of said first and second legs relative to said attachment means so that movement beyond said second positions of said first and second legs is prohibited.

7. A self-supporting container for holding objects, said container comprising:

(a) a substantially tubular container body having an upper edge, a lower edge, an outer surface, and an open interior;

(b) a supporting apparatus for attachment to said container to selectively support said container in an orientation in which the weight of said container is distributed between said container and said supporting apparatus, said supporting apparatus including i) a bracket having an attachment plate securable to said object, said attachment plate defining a weight-support line;

ii) a first leg moveable coupled to said bracket so that said first leg selectively resides in one of a first position generally parallel to said weight-supporting line and a second position at an acute angle to said weight-supporting line;

iii) a second leg moveably coupled to said bracket so that said second leg selectively resides in one of a first position generally parallel to said weight-supporting line and a second position at an acute angle with said first leg when said first and second legs are in said second positions;

iv) biasing means for urging said first and second legs toward said second positions;

v) retaining means for holding said first and second legs in said first position against the urging of said biasing means, said retaining means including shelf means extending substantially perpendicularly from the outer surface of said container body at a location spaced below said bracket, said shelf means being formed of resilient thermoplastic material; and a pair of key hole slots formed in said shelf means, each slot for receiving one of said legs to hold said leg in said first position; and vi) stop means for limiting rotation of said first and second legs relative to said attachment means so that movement beyond said second positions of said first and second legs is prohibited.

8. The container according to claim 7, further comprising a lid securable to said container body for selectively covering the interior of said container body.

9. The container according to claim 8, wherein said lid is hingedly coupled to said container body.

10. The container according to claim 7, further comprising liner means disposed within said container body for protecting the interior of said container body and the contents of said body.

11. The container according to claim 7, further comprising divider means for dividing the interior of said container into a plurality of separate compartments.

12. The container according to claim 10, wherein said liner comprises divider means for dividing the interior of said container into a plurality of separate compartments.

13. The container according to claim 8, further comprising liner means in said container body and said lid for protecting the interior of said container body, said lid, and the contents of said body.

14. The container according to claim 11, wherein said divider means comprises a plurality of rigid tubes secured within said interior.

* * * * *

UNITED STATES PATENT AND TRADEMARK OFFICE

CERTIFICATE OF CORRECTION

PATENT NO. : 5,082,218

DATED : January 21, 1992

INVENTOR(S) : Ronald W. Hoffman

It is certified that error appears in the above-identified patent and that said Letters Patent is hereby corrected as shown below:

In claim 7, line 14, change "weight-support" to --weight-supporting--.

In claim 7, line 15, change "moveable" to --moveably--.

In claim 7, line 24, after "angle" insert --to said weight-supporting line, said second leg being at an angle--.

Signed and Sealed this

Twenty-seventh Day of April, 1993

*Attest:*

MICHAEL K. KIRK

*Attesting Officer*

*Acting Commissioner of Patents and Trademarks*